US009857037B1

(12) United States Patent
Wu et al.

(10) Patent No.: US 9,857,037 B1
(45) Date of Patent: Jan. 2, 2018

(54) ASSEMBLING STRUCTURE FOR LED LUMINAIRE

(71) Applicant: GLT CORPORATION, Tainan (TW)

(72) Inventors: Wen-Liang Wu, Tainan (TW); Kuan-Ling Tseng, Kaohsiung (TW)

(73) Assignee: GLT Corporation, Tainan (TW)

( * ) Notice: Subject to any disclaimer, the term of this patent is extended or adjusted under 35 U.S.C. 154(b) by 0 days.

(21) Appl. No.: 15/194,942

(22) Filed: Jun. 28, 2016

(51) Int. Cl.

| | |
|---|---|
| ***F21S 4/00*** | (2016.01) |
| ***F21V 19/02*** | (2006.01) |
| ***F21S 4/28*** | (2016.01) |
| ***F21V 17/02*** | (2006.01) |
| ***F21V 23/00*** | (2015.01) |
| ***F21V 21/008*** | (2006.01) |
| ***F21Y 115/10*** | (2016.01) |

(52) U.S. Cl.
CPC ..... *F21S 4/28* (2016.01); *F21V 17/02* (2013.01); *F21V 21/008* (2013.01); *F21V 23/001* (2013.01); *F21Y 2115/10* (2016.08)

(58) Field of Classification Search
CPC .... F21S 4/28; F21S 8/066; F21S 8/046; F21S 8/038; F21V 17/02; F21V 21/34; F21V 21/30; F21V 19/0045
USPC ..... 362/220, 648, 150
See application file for complete search history.

(56) References Cited

U.S. PATENT DOCUMENTS 5,772,315 A * 6/1998 Shen ..... F21V 21/08 362/249.07
6,135,615 A * 10/2000 Lee ..... F21V 21/35 362/147
2003/0137835 A1* 7/2003 Mier-Langner ..... F21S 8/06 362/220
2011/0002120 A1* 1/2011 Song ..... F21S 2/005 362/249.02
2013/0329413 A1* 12/2013 Cotta, Sr. ..... B60Q 1/0483 362/220
2015/0316238 A1* 11/2015 Guilmette ..... H01R 25/14 362/218
2016/0265756 A1* 9/2016 Silver ..... F21S 8/02

FOREIGN PATENT DOCUMENTS

TW M512672 U 11/2015

* cited by examiner

*Primary Examiner* — Peggy Neils
*Assistant Examiner* — William N Harris
(74) *Attorney, Agent, or Firm* — Muncy, Geissler, Olds & Lowe, P.C.

(57) ABSTRACT

The present invention provides an assembling structure for LED luminaire, including a main support, at least one LED luminaire and at least one connecting part. The main support includes front faces on radial side, slide tracks on the front faces, and two side faces. The LED luminaire includes a cap-like housing and a lamp-connecting portion. The connecting part includes a first locating block provided in one slide track, a second locating block passing through each side face and provided in another slide track different from that for the first locating block, and a support body connected with the first and second locating blocks while extending far away from the main support. The support body is connected, at one end far away from the first and second locating blocks, with the lamp-connecting portion, while the connecting part and LED luminaire are pivoted with respect to the main support.

7 Claims, 9 Drawing Sheets

ASSEMBLING STRUCTURE FOR LED LUMINAIRE

FIELD OF THE INVENTION

The present invention is related to an assembling structure for LED luminaire, particularly to an assembling structure for LED luminaire allowed for easy manipulation and individual adjustment of illumination angle for each luminaire.

BACKGROUND OF THE INVENTION

Light-emitting diodes (LEDs) are provided with advantages, such as low power consumption, long service life, small volume and fast response, so as to be applied to LED lighting equipments in recent years. The LED lighting equipments are made in accordance with standard specifications of various watts, depending upon the requirement from operating environment. Furthermore, the illumination required in accordance with special specifications should be customized. For instance, general LED lighting equipments could not meet the condition of an environment where high illuminance is required.

In Taiwan utility model publication No. M512672, for example, there is provided with an LED lamp with the function of angular adjustment, which comprises an LED lamp and an angle-adjusting means. The LED lamp includes a radiating body, a plurality of light-emitting modules, and a plurality of translucent modules. The radiating body is provided with a radiating wall, two side walls, and a plurality of radiating fins extending outward. The angle-adjusting means includes two angle-adjusting tabs and a handle pivotingly connected with these angle-adjusting tabs. Moreover, the two angle-adjusting tabs are secured to the radiating body. In this way, in the above-mentioned LED lamp with the function of angular adjustment, lamps of various watts in combination with various illumination angles are used in response to different requirements of illumination, so as to achieve the object of modularization. In the above-mentioned LED lamp, however, the light-emitting modules are assembled through the handle with two supporting arms. It is still necessary to add other auxiliary means to the conventional LED lamp, if three or more light-emitting modules should be connected or the interval between light-emitting modules should be adjusted. Thus, difficulty in component sharing and inconvenient manipulation for the user are resulted. Moreover, each light-emitting module should be made under specifications in correspondence with the handle, which also results in restriction on angular adjustment. In addition, it is impossible for each light-emitting module to be rotated so as to adjust the angle individually, which results in inconvenient usage if several light-emitting modules are connected to the conventional LED lamp at the same time. Accordingly, the improvement on the prior art is truly necessary.

SUMMARY OF THE INVENTION

It is the object of the present invention to solve the problems, such as poor flexibility in positional adjustment and inconvenient manipulation for the user, of the LED lamp in the prior art.

For achieving the above object, the present invention provides an assembling structure for LED luminaire, including a generally elongated main support, at least one LED luminaire, and at least one connecting part for connecting the main support with the LED luminaire. The main support includes a plurality of front faces on the radial side, a plurality of slide tracks provided on respective front faces, and two side faces located at the ends of respective slide tracks and adjoined to the front faces, respectively. The LED luminaire includes a cap-like housing and a lamp-connecting portion provided on the cap-like housing. The connecting part includes at least one first locating block allowed for passing through each side face and provided in one slide track, at least one second locating block allowed for passing through each side face and provided in another slide track different from the one slide track for the first locating block, and a support body connected with the first locating block and the second locating block as well as extending far away from the main support. The support body is connected, at one end far away from the first locating block and the second locating block, with the lamp-connecting portion, while the connecting part and the LED luminaire may be pivoted with respect to the main support.

Further, the first locating block and the support body are operably pivotingly connected. The connecting part includes a curved track cuttingly provided in the support body, and a position-limiting pivot allowed for sliding in the curved track while fixedly connected with the second locating block.

Further, the connecting part includes a bolt screwing the first locating block to the support body with adjustable tension. Moreover, each of said first locating blocks and each of said second locating blocks are provided on each of two opposite front faces of the main support, respectively.

Further, the first locating block and the second locating block are fixedly connected with the support body. The connecting part includes a curved track cuttingly provided in the support body, and a position-limiting slide bar allowed for sliding in the curved track, the position-limiting slide bar being connected with the lamp-connecting portion. Moreover, the first locating block and the second locating block are both located on the same front face.

Further, the assembling structure for LED luminaire further includes at least one hanger base connected to the main support. The hanger base includes a hanger-locating block provided in at least one of the slide tracks, and a hanging hook connected with the hanger-locating block.

Further, the LED luminaire includes a cable extending outward from the cap-like housing. The main support includes a passage passing through each of the side faces, a cover enclosing the passage from each of the side faces, and a wiring hole cuttingly provided in the cover as well as allowing the cable to pass therethrough.

It is another object of the present invention to provide an assembling structure for LED luminaire, including at least one LED luminaire and at least one connecting part. The LED luminaire includes a cap-like housing and a lamp-connecting portion provided on the cap-like housing. The connecting part includes a support body and a pivoting mechanism connected with the support body and the lamp-connecting portion.

Further, each of the LED luminaires is connected in series by means of a plurality of cables, as well as each of the connecting parts includes a base connected with the support body and far away from the lamp-connecting portion.

Accordingly, beneficial effects of the present invention in comparison with prior art are as follows.

1. In the assembling structure for LED luminaire of the present invention, the position of the LED luminaire may be slidingly varied in the slide track by means of the first locating block and second locating block, by connecting the first locating block and second locating block of the connecting part to the LED luminaire. Thereby, it is convenient to adjust the interval between LED luminaires. Further, each LED luminaire may be rotated to adjust the angle and region of illumination individually, and may be installed without the need for additionally designing corresponding components, such as supports. Thus, advantageous, such as flexible adjustment of position and easy manipulation for the user, for example, may be possessed.

2. The components, such as the main support, first locating block and second locating block, for example, of the assembling structure for LED luminaire of the present invention may be combined into various assembling configurations for LED luminaire depending upon the user requirement. Moreover, the components used in various assembling configurations are adapted to the same specification. Therefore, the advantage of cost savings in manufacturing is provided.

DETAILED DESCRIPTION OF THE PREFERRED EMBODIMENTS

Figure 1:
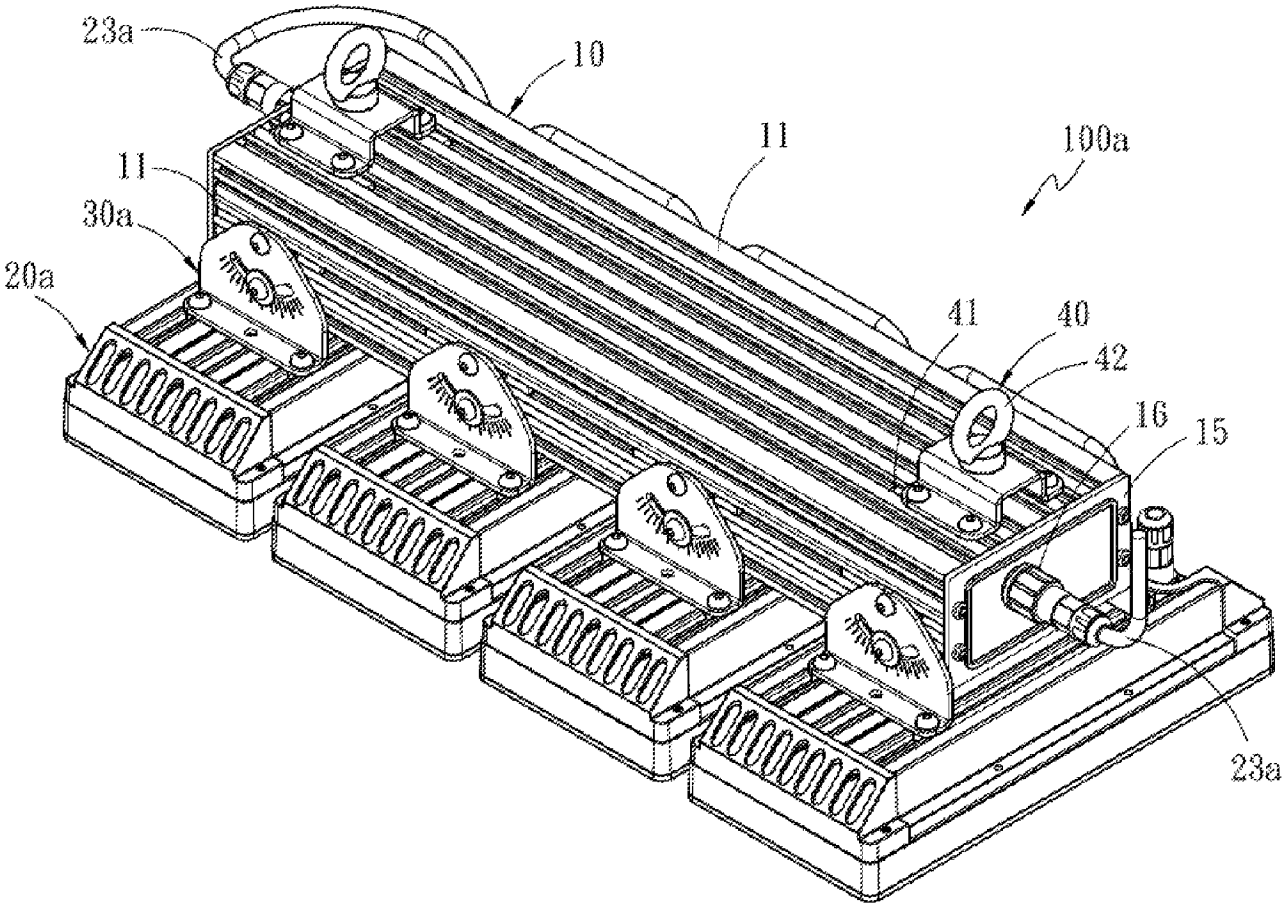
FIG. 1 is a perspective view of a first embodiment of the present invention.

In regard to technique of the present invention, an assembling structure for LED luminaire 100*a* according to a first embodiment of the present invention is illustrated in FIG. 1. The assembling structure for LED luminaire includes a generally elongated main support 10, at least one LED luminaire 20*a*, and at least one connecting part 30*a* for connecting the main support 10 with the LED luminaire 20*a*. The present invention may be applied to illuminating lamps, such as yard lights, projecting lamps, street lights and wall washers. The above-mentioned purposes are only exemplary, however, without limiting the scope of protection for the present invention.

Figure 2:
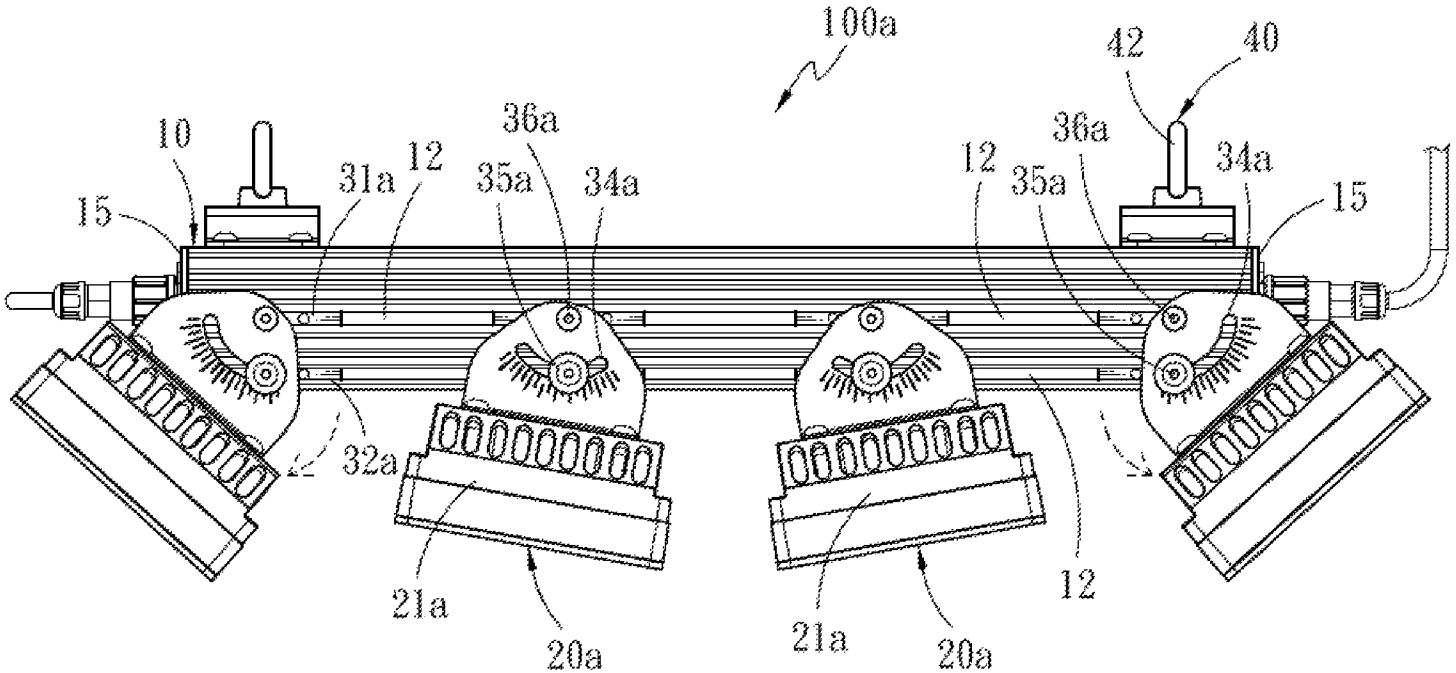
FIG. 2 is an operating diagram of the first embodiment of the present invention.
Figure 3:
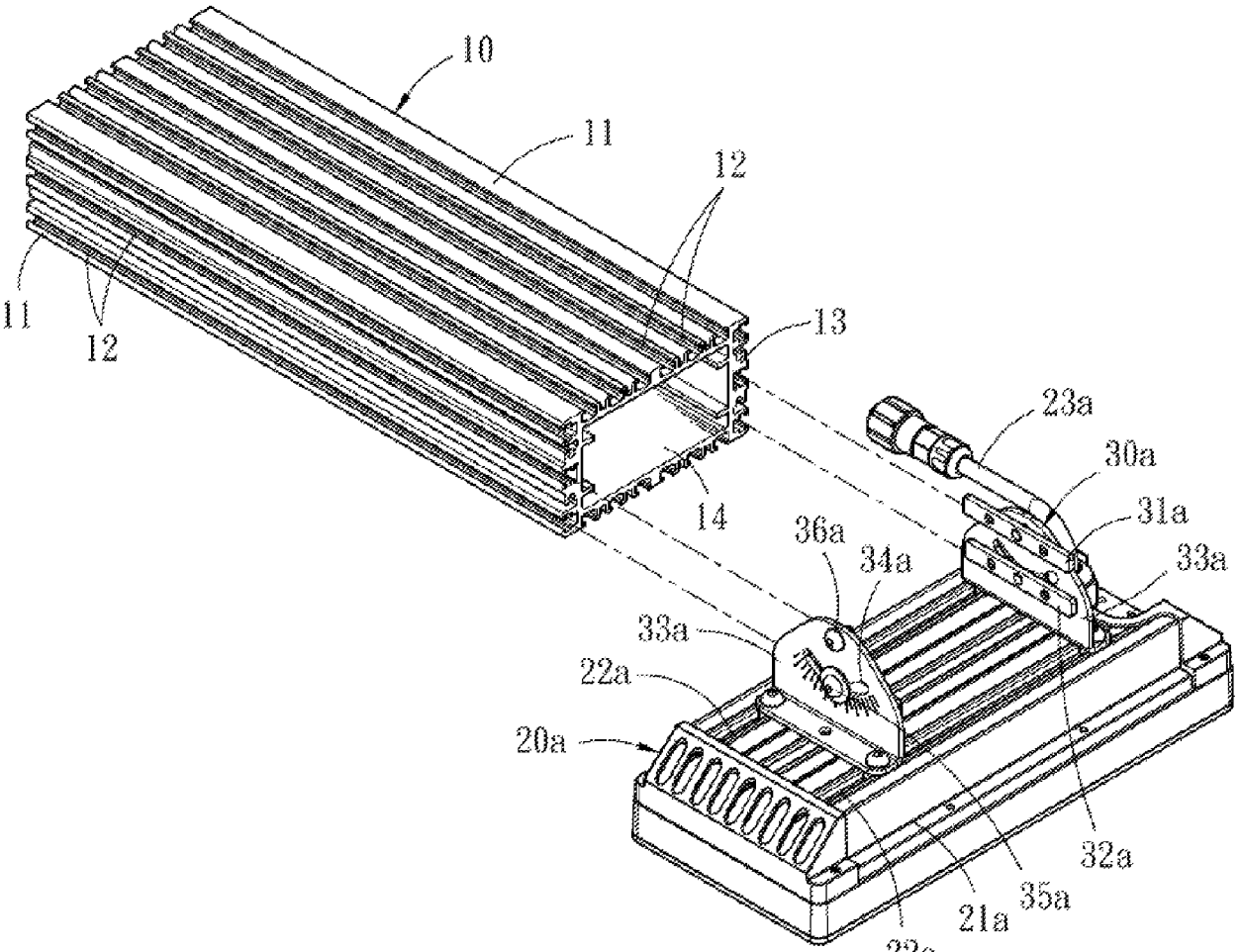
FIG. 3 is a partly disassembled view of the first embodiment of the present invention.

Specifically, referring to FIGS. 2 and 3 together, the main support 10 includes a plurality of front faces 11 on the radial side, a plurality of slide tracks 12 provided on respective front faces 11, and two side faces 13 located at the ends of respective slide tracks 12 and adjoined to the front faces 11, respectively. In this embodiment, the main support 10 may be aluminum extrusion of a length adjusted as required by the user. The "radial direction" of the main support 10 is specifically directed to what is orthogonal to an axial direction when the direction of extension of the long side of the main support 10 is directed to the axial direction. The LED luminaire 20*a* includes a cap-like housing 21*a* and a lamp-connecting portion 22*a* provided on the cap-like housing 21*a*. In this embodiment, the lamp-connecting portion 22*a* may be grooves (such as the grooves on the radiating fins, for example) on the cap-like housing 21*a* or screw holes on the cap-like housing 21*a* of the LED luminaire 20*a*. Only the object of connection should be achieved without limiting the configuration for the lamp-connecting portion 22*a* herein. The connecting part 30*a* includes at least one first locating block 31*a* allowed for passing through each side face 13 and provided in one slide track 12, at least one second locating block 32*a* allowed for passing through each side face 13 and provided in another slide track 12 different from the one slide track 12 for the first locating block 31*a*, and a support body 33*a* connected with the first locating block 31*a* and the second locating block 32*a* as well as extending far away from the main support 10. The support body 33*a* is connected, at one end far away from the first locating block 31*a* and the second locating block 32*a*, with the lamp-connecting portion 22*a*, while the connecting part 30*a* and the LED luminaire 20*a* may be pivoted with respect to the main support 10.

Then, the first locating block 31*a* and the support body 33*a* are operably pivotingly connected. The connecting part 30*a* includes a curved track 34*a* cuttingly provided in the support body 33*a*, and a position-limiting pivot 35*a* allowed for sliding in the curved track 34*a* while fixedly connected with the second locating block 32*a*. The above-mentioned "operably pivotingly connected" is directed to possibly switching the connection of the first locating block 31*a* with the support body 33*a* between pivoting connection and fixing connection through the operation of the user. In this embodiment, the support body 33*a* may be secured to the first locating block 31*a* by means of through holes provided in the first locating block 31*a* and the support body 33*a* together with a bolt 36*a* passing through these through holes. Also, the bolt 36*a* may be released by the user, so as to adjust the angle of rotation of the support body 33*a* with respect to the first locating block 31*a*. Moreover, the bolt 36*a* may be used for fixing the position of the first locating block 31*a* in the slide track 12. In his embodiment, moreover, each connecting part 30*a* is corresponded to two first locating blocks 31*a* and two second locating blocks 32*a*. Each of the first locating blocks 31*a* and each of the second locating blocks 32*a* are provided on each of two opposite front faces 11 of the main support 10, respectively, so as to form an assembling configuration striding across the main support 10. This configuration is allowed for fitting the LED luminaire 20*a* for the main support 10 closely, and further, increasing space usage efficiency. In the above-mentioned structure, the support body 33*a* may be rotated with respect to the first locating block 31*a*, and the position-limiting pivot 35*a* may be then rested against the edge of the curved track 34*a* so as to obtain the effect of position limitation when a certain degree of rotation is reached. Thus, the horizontal position of each LED luminaire 20*a* of the present invention may be varied along each slide track 12, while the angle of rotation of each LED luminaire 20*a* may be adjusted individually. The objects of easy manipulation and installation for the user, as well as adjustment of region and angle of illumination depending upon the illumination requirement are achieved.

Referring to FIG. 1 again, the assembling structure for LED luminaire 100*a* further includes at least one hanger base 40 connected to the main support 10. The hanger base 40 includes a hanger-locating block 41 provided in at least one of the slide tracks 12, and a hanging hook 42 connected with the hanger-locating block 41. Thereby, the assembling structure for LED luminaire 100*a* may be hanged on the structure, such as ceilings, roof frames and other supports. In addition, the LED luminaire 20*a* includes a cable 23*a* extending outward from the cap-like housing 21*a*. The main support 10 includes a passage 14 passing through each of the side faces 13, a cover 15 enclosing the passage 14 from each of the side faces 13 (referring to FIG. 3), and a wiring hole 16 cuttingly provided in the cover 15 as well as allowing the cable 23*a* to pass therethrough. It is possible for the user to accommodate the cable 23*a* within the passage 14, and further, increase space usage efficiency.

Figure 4:
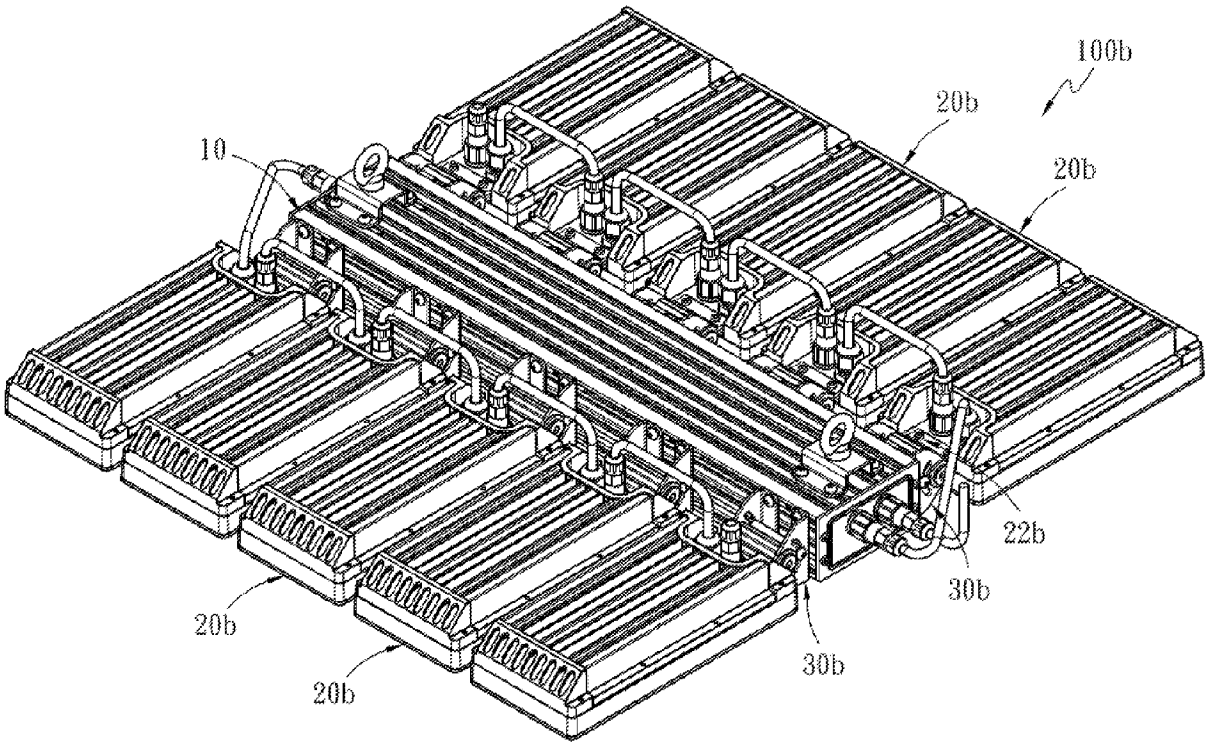
FIG. 4 is a perspective view of a second embodiment of the present invention.
Figure 5:
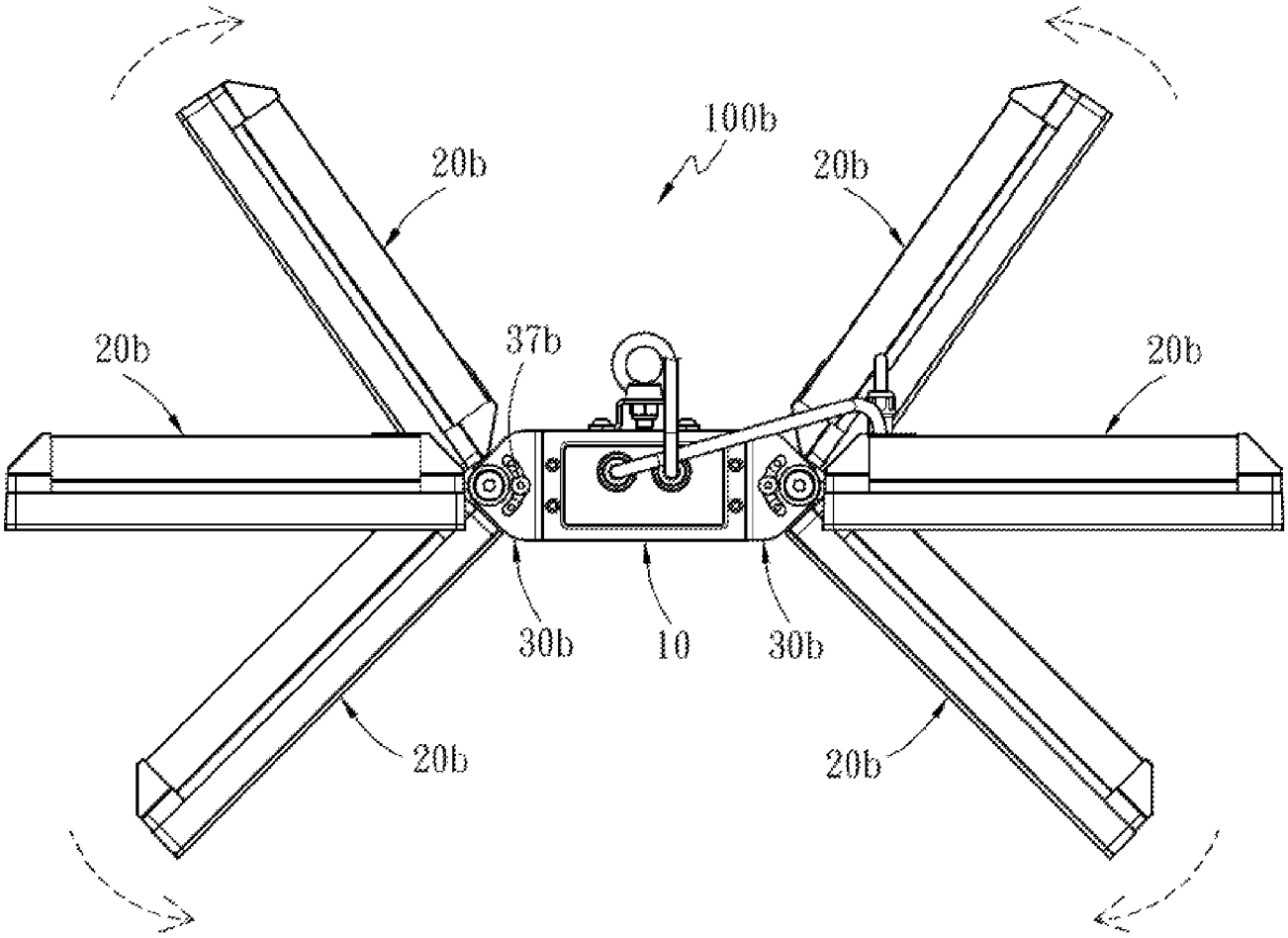
FIG. 5 is an operating diagram of the second embodiment of the present invention.
Figure 6:
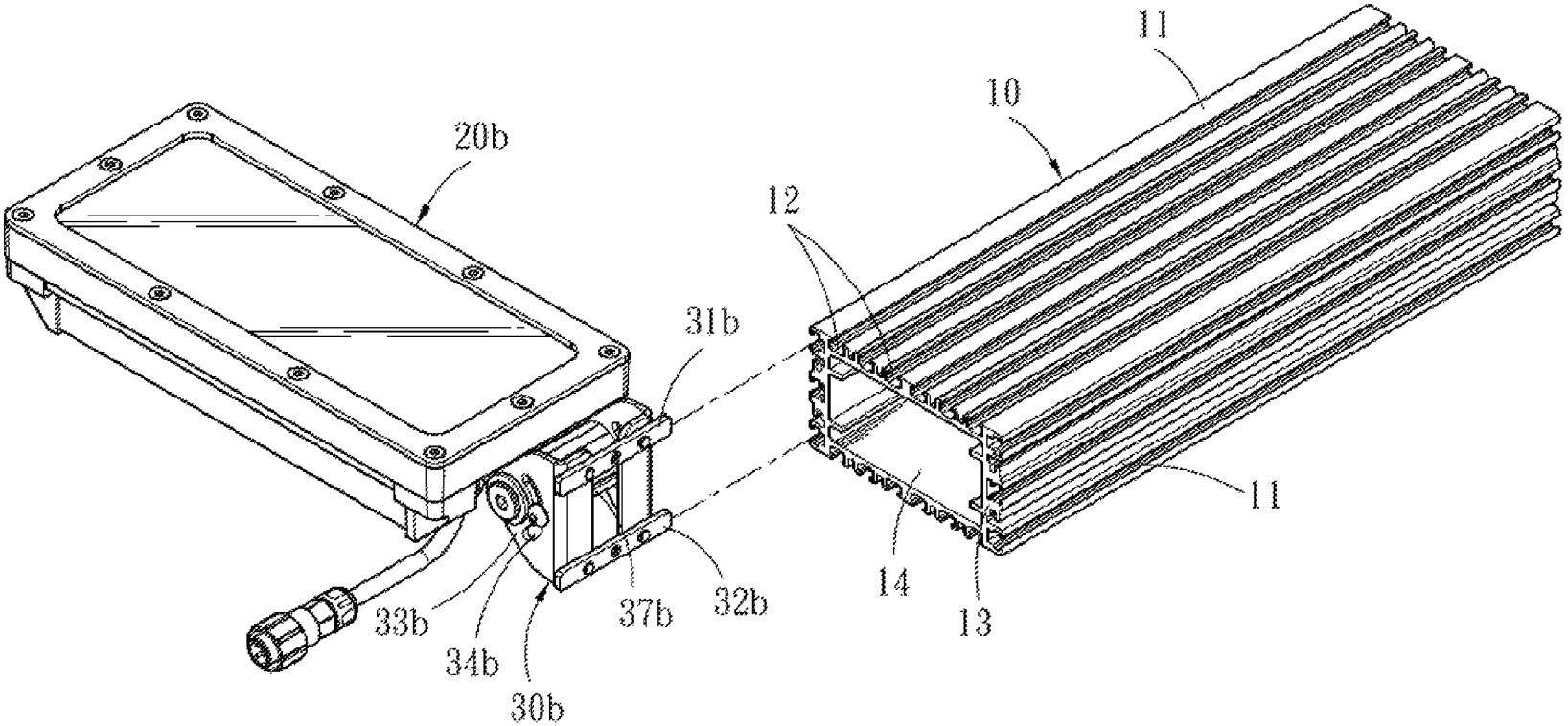
FIG. 6 is a partly disassembled view of the second embodiment of the present invention.

Referring to FIGS. 4 to 6 together, there are shown an assembling structure for LED luminaire 100*b* according to a second embodiment of the present invention. The main support 10, each of the LED luminaires 20*b* and the connecting parts 30*b* of this embodiment are all substantially the same as corresponding components of the first embodiment. The difference between these two embodiments is that the first locating block 31*b* and the second locating block 32*b* are fixedly connected with the support body 33*b*, while the first locating block 31*b* and the second locating block 32*b* are both located on the same front face 11. The connecting part 30*b* includes a position-limiting slide bar 37*b* allowed for sliding in the curved track 34*b*, and the position-limiting slide bar 37*b* is connected with the lamp-connecting portion 22*b*. When the position-limiting slide bar 37*b* reaches the bottom end of the curved track 34*b* by sliding, the lamp-connecting portion 22*b* may be restricted to be non-deflectable, and the position-limiting effect may be further achieved. Therefore, each of the LED luminaires 20*b* of the present invention may be also angularly rotated with respect to one of the front faces 11 of the main support 10, so as to achieve the object of self-adjustment of various angles and regions of illumination depending upon illumination requirement.

Figure 7:
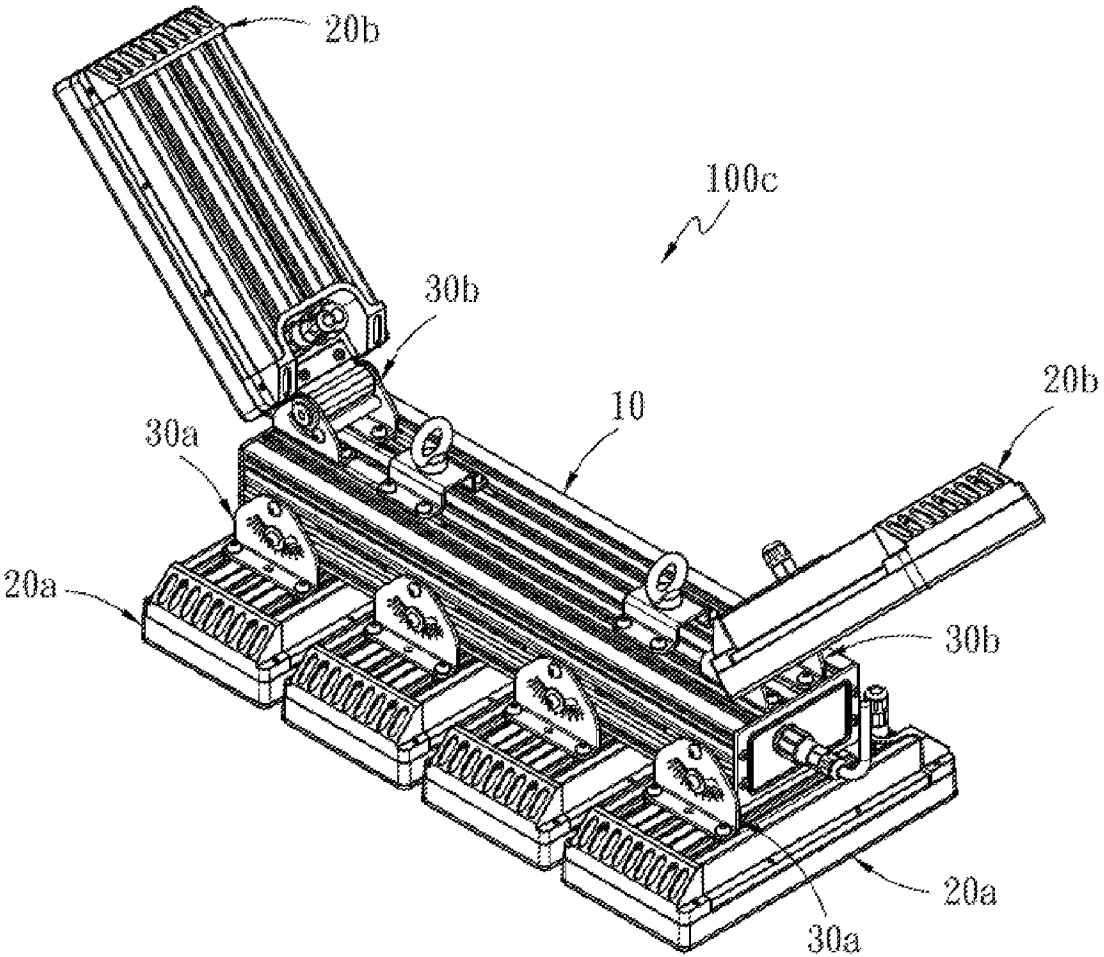
FIG. 7 is a perspective view of a third embodiment of the present invention.

Referring to FIG. 7, there is shown an assembling structure for LED luminaire 100*c* according to a third embodiment of the present invention, which is, specifically, the integration of the first embodiment with the second embodiment. As illustrated in the figure, each of the LED luminaires 20*a* connected as the first embodiment is connected with the two opposite front faces 11 of the main support 10 by means of one connecting part 30*a*, and is provided with a light-emitting surface facing toward the bottom of the drawing. Furthermore, each of the LED luminaires 20*b* connected in accordance with the second embodiment is connected with one of the front faces 11 of the main support 10 by means of one connecting part 30*b*, and is provided with a light-emitting surface facing toward the flank of the main support 10 obliquely, in such a way that the assembling structure for LED luminaire 100*c* is capable of projecting in various directions and angles.

Figure 8:
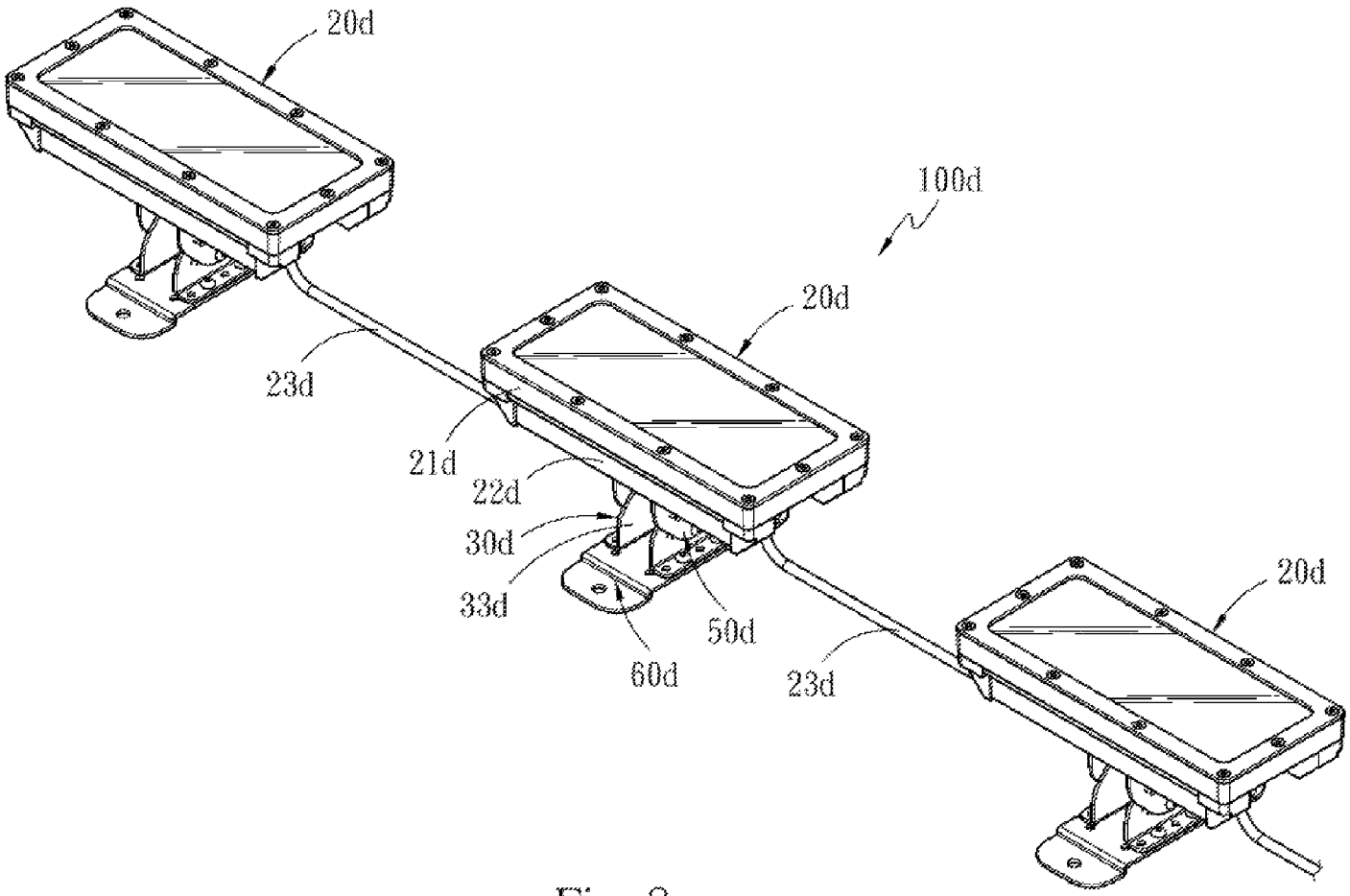
FIG. 8 is a perspective view of a fourth embodiment of the present invention.
Figure 9:
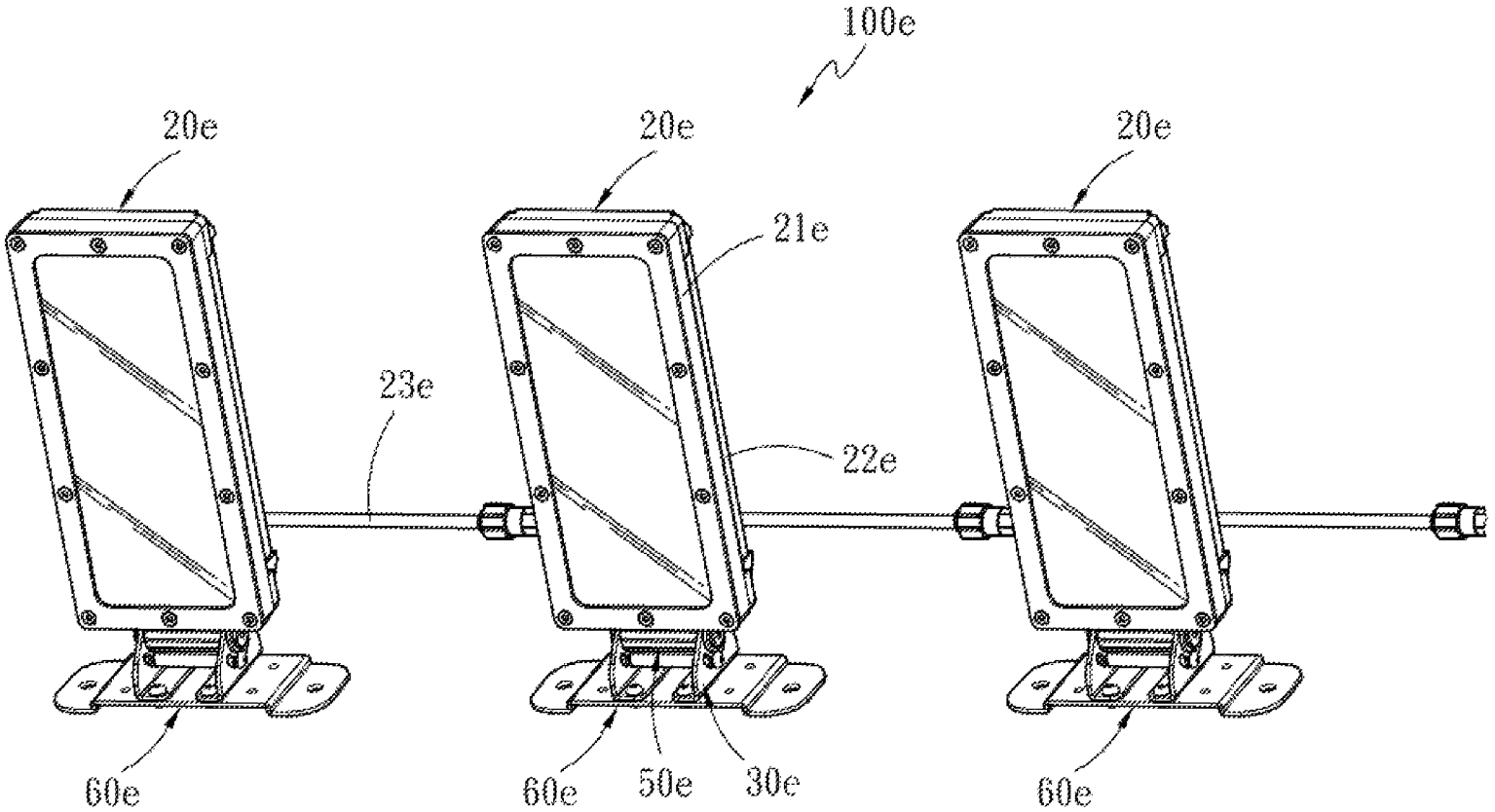
FIG. 9 is a perspective view of a fifth embodiment of the present invention.

Referring to FIG. 8, there is shown an assembling structure for LED luminaire 100*d* according to a fourth embodiment of the present invention. In this embodiment, the assembling structure for LED luminaire 100*d* includes an LED luminaire 20*d* and a connecting part 30*d*. The LED luminaire 20*d* includes a cap-like housing 21*d* and a lamp-connecting portion 22*d* provided on the cap-like housing 21*d*. The connecting part 30*d* includes a support body 33*d* and a pivoting mechanism 50*d* connected with the support body 33*d*. As illustrated in the figure, several LED luminaires 20*d* of this embodiment are connected in series by means of a plurality of cables 23*d*, as well as each of the connecting parts 30*d* includes a base 60*d* connected with the support body 33*d* and far away from the lamp-connecting portion 22*d*. This base 60*d* may be used for connecting to another support. Referring to FIG. 9, additionally, there is shown an assembling structure for LED luminaire 100*e* according to a fifth embodiment of the present invention, the configuration of the connecting part 30*e* may be also changed as that of the connecting part 30*b* of the second embodiment (referring to FIGS. 4 to 6). The effect of individual adjustment of angle and region of each LED luminaire 20*e* is similarly achieved by means of above-mentioned structure.

To sum up, the assembling structure for LED luminaire of the present invention is allowed for the user to adjust the interval between the LED luminaires, while each LED luminaire may be rotated to adjust the angle and region of illumination individually. Then, advantageous, such as flexible adjustment of position and easy manipulation for the user, for example, may be possessed.

What is claimed is:

1. An assembling structure for LED luminaire, comprising:

an elongated main support, comprising a plurality of front faces on a radial side thereof, a plurality of slide tracks provided on respective front faces, and two side faces located at ends of respective slide tracks and adjoined to said front faces, respectively;

at least one LED luminaire, comprising a housing and a lamp-connecting portion provided on said housing; and at least one connecting part for connecting said main support with said LED luminaire, comprising at least one first locating block allowed for passing through each side face and provided in one slide track, at least one second locating block allowed for passing through each side face and provided in another slide track different from said one slide track for said first locating block, and a support body connected with said first locating block and said second locating block as well as extending away from said main support, said support body being connected, at one end spaced from said first locating block and said second locating block, with said lamp-connecting portion, while said connecting part and said LED luminaire being pivoted with respect to said main support, wherein said first locating block and said support body are operably pivotingly connected, said connecting part comprising a curved track cuttingly provided in said support body, and a position-limiting pivot allowed for sliding in said curved track while fixedly connected with said second locating block.

2. The assembling structure for LED luminaire according to claim 1, wherein said connecting part comprises a bolt screwing said first locating block to said support body with adjustable tension.

3. The assembling structure for LED luminaire according to claim 1, wherein each of said first locating blocks and each of said second locating blocks are provided on each of two opposite front faces of said main support, respectively.

4. The assembling structure for LED luminaire according to claim 1, wherein said first locating block and said second locating block are fixedly connected with said support body, said connecting part comprising a curved track cuttingly provided in said support body, and a position-limiting slide bar allowed for sliding in said curved track, said position-limiting slide bar being connected with said lamp-connecting portion.

5. The assembling structure for LED luminaire according to claim 4, wherein said first locating block and said second locating block are both located on the same front face.

6. The assembling structure for LED luminaire according to claim 1, further comprising at least one hanger base connected to said main support, said hanger base comprising a hanger-locating block provided in at least one of said slide tracks, and a hanging hook connected with said hanger-locating block.

7. The assembling structure for LED luminaire according to claim 1, wherein said LED luminaire comprises a cable extending outward from said housing, said main support comprising a passage passing through each of said side faces, a cover enclosing said passage from each of said side faces, and a wiring hole cuttingly provided in said cover as well as allowing said cable to pass therethrough.

* * * * *